United States Patent [19]

Welch

[11] Patent Number: 4,777,929

[45] **Date of Patent: * Oct. 18, 1988**

[54] MOUNTING FOR DUTY CYCLE CONTROL SWITCH FOR CEILING MOUNTED DUCTLESS HEATER

[75] Inventor: Dean Welch, Badin, Pa.

[73] Assignee: Temper-Sensor, Inc., Florence, Ky.

[ * ] Notice: The portion of the term of this patent subsequent to May 12, 2004 has been disclaimed.

[21] Appl. No.: 12,893

[22] Filed: Feb. 10, 1987

Related U.S. Application Data

[63] Continuation of Ser. No. 770,877, Aug. 29, 1985, Pat. No. 4,664,311.

[51] Int. Cl.[4] ..... F24C 3/02

[52] U.S. Cl. ..... 126/89; 236/11; 236/38; 337/207

[58] Field of Search ..... 236/11, 10, DIG. 19, 236/38, 95, 96; 126/89, 90 R; 219/364; 337/207, 327, 398; 165/39

[56] References Cited

U.S. PATENT DOCUMENTS

| | | | |
|---|---|---|---|
| 1,760,082 | 5/1930 | Parks . | |
| 1,992,155 | 2/1935 | Dillman . | |
| 2,147,658 | 2/1939 | Lefick | 165/39 X |
| 2,213,018 | 8/1940 | Perkins | 165/39 X |
| 2,582,066 | 1/1952 | Resek . | |
| 2,863,978 | 12/1958 | Young . | |
| 2,919,068 | 12/1959 | Kautz . | |
| 3,089,942 | 5/1963 | Wrigglesworth et al. . | |
| 3,743,180 | 7/1973 | Perkins et al. . | |
| 4,141,496 | 2/1979 | Duchek . | |
| 4,266,406 | 5/1981 | Ellis . | |
| 4,470,267 | 9/1984 | Davis et al. . | |

*Primary Examiner*—William E. Wayner
*Attorney, Agent, or Firm*—Wood, Herron & Evans

[57] ABSTRACT

A temperature sensitive duty cycling control switch is mounted to a forced air ductless gas or oil heater by a special mounting bracket. The bracket attaches to the front of the heater in the path of the heated airflow. The mounting device is basically a tapered conduit or duct which is held at a distance from the heater so that it does not unduly obstruct the airflow and is tapered to concentrate air generated by the heater onto a plate mounted in front of the duct. The duty cycling control switch is then mounted to this plate and responds to the temperature of the plate. This enables the cycling of the heater burner while the fan continues to operate.

1 Claim, 2 Drawing Sheets

MOUNTING FOR DUTY CYCLE CONTROL SWITCH FOR CEILING MOUNTED DUCTLESS HEATER

This is a continuation, of application Ser. No. 770,877, filed Aug. 29, 1985, now U.S. Pat. No. 4,664,311.

The present invention relates to a furnace or heater control switch and more particularly to a temperature sensitive furnace control switch for activating and de-activating a fuel valve on a gas or oil fired forced air heater.

More particularly, the present invention relates to a temperature sensitive duty cycling control switch for use with and mounted to a ceiling mounted ductless gas or oil heater.

Ceiling mounted gas heaters are very basic heaters used to heat areas where aesthetics are not important such as for example a manufacturing plant or a garage. They primarily include a fire box where gas or oil is burned, a series of heat exchange tubes which extend through the fire box and a blower or fan for forcing the air through these heat exchange tubes. Unlike residential forced air furnaces, these heaters have no plenum and no duct work. Room air is simply blown into the heat exchange tubes and back out into the room.

The burner is activated by a thermostat. The blower is activated by heat sensing switch which is responsive to the temperature in the fire box. This switch activates the blower when a predetermined temperature is sensed. The blower continues until the sensed temperature is lower than this temperature. The blower would typically continue even after the burner shuts off to utilize residual heat in the fire box.

Generally the burner continues to operate until the temperature in the area being heated opens the thermostat. This presents a problem when the area is not heated quickly. The efficiency of a ceiling mounted heater falls off quickly after the heat exchanger is fully loaded. At this point the air in the fire box is so hot that it no longer efficiently increases the temperature of the air passing through the heat exchange tubes. The hot combustion product simply pass up through the fire box out the flue.

This problem has also been encountered with residential forced air furnaces. A solution to this problem has been to use an adjustable temperature sensitive switch mounted to the exterior of the plenum of the furnace and which is wired in line between the thermostat and the fuel solenoid valve. The temperature sensitive switch mounted to the furnace plenum is adjusted so that after the heat exchangers are fully loaded the temperature of the exterior of the plenum (which is proportional to the temperature of the heat exchanger) causes the switch to open which in turn closes the fuel solenoid valve thereby de-activating the furnace burner. The blower continues to force air through the heat exchangers drawing out heat. Since it is adjustable the switch can be set for a particular furnace to deactivate the burner only when that furnace is no longer operating efficiently. Such a switch and the method of operating such a switch are disclosed in U.S. Pat. No. 4,470,267, invented by Davis et al, the disclosure of which is incorporated herein by reference.

The switch disclosed in this patent is per se unsuitable for use with a ductless ceiling mounted heater. These heaters do not have an accessible plenum to mount the temperature sensitive switch. Further the switch cannot be simply mounted in front of the furnace to sense the temperature of the heated air exhausted from the furnace. If it is mounted directly against the front of the furnace it interferes with airflow and causes the heater to overheat. If the switch is held out at a distance far enough away from the heater that it does not interfere with airflow, the switch is inconsistent. Too much ambient air mixes with the heated air at these distances to provide for reliable measurement of temperature.

Accordingly it is an object of the present invention to provide a method of mounting a duty cycling control switch to a ductless ceiling mounted heater. Further it is an object of the present invention to provide such a means to mount a duty cycling control switch wherein the switch does not interfere with the airflow for the heater but consistently measures the temperature of the heated air exhausted from the heater to permit duty cycling of the heater with an adjustable duty cycle switch.

These objects and advantages are provided by mounting a duty cycling control switch to a ceiling mounted furnace using bracket which includes a tapered duct and a mounting plate forward of the small end of the duct. The bracket is mounted to the heater with the enlarged end of the duct facing the ceiling heater but spaced from the heater so as not to interfere with airflow. Heated air exhausted from the ceiling mounted heater passes through the tapered duct which concentrates the flowing air and directs it against the plate. The temperature sensitive switch is mounted to the plate and is therefore responsive to the heat of the gas emitted from the ceiling mounted heater. By appropriate adjustment of the switch the burner can be shut off when the heat exchanger is so hot that the heater is no longer operating efficiently, i.e., when it is fully loaded.

Further the tapered duct is held about 10–12 inches in front of the ceiling heater. Therefore it does not unduly restrict the airflow. However because of its tapered configuration it concentrates the air emitted from the heater and directs it to the plate upon which the temperature sensitive switch is mounted providing for consistent measurement of temperatures and duty cycling of the heater.

Other objects and advantages of the present invention will be appreciated in light of the following detailed description and drawings wherein.

DETAILED DESCRIPTION

Figure 1:
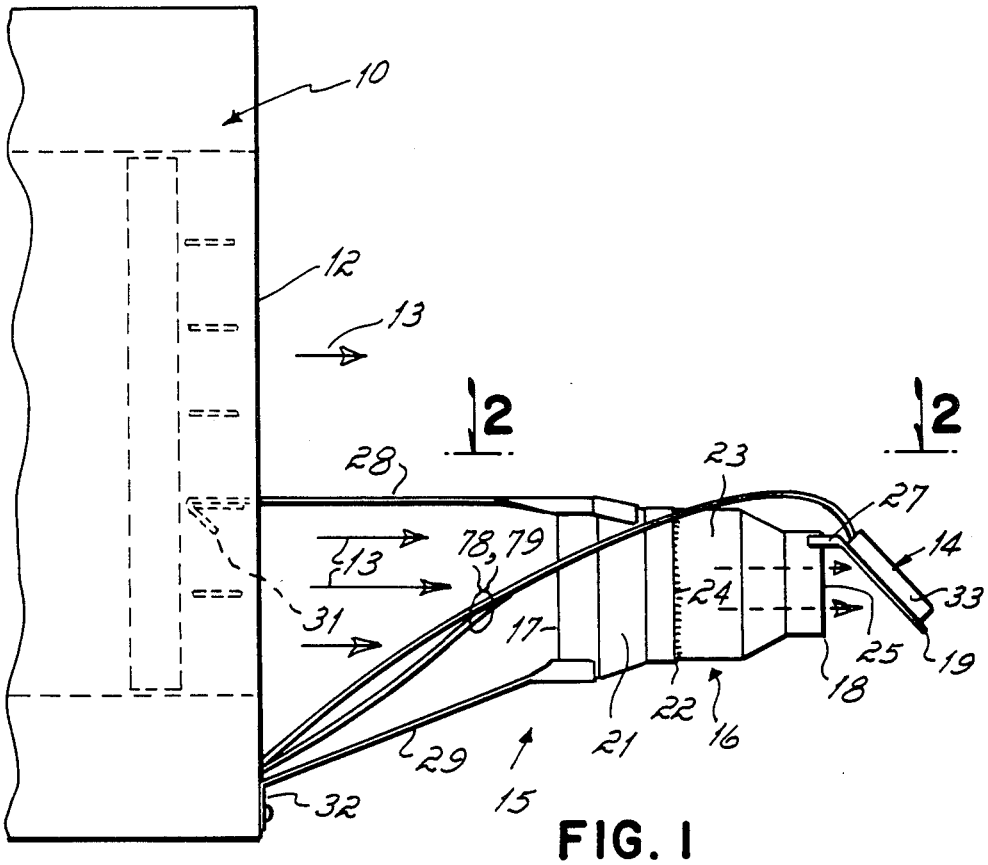
FIG. 1 is a side plan view of the present invention.
Figure 2:
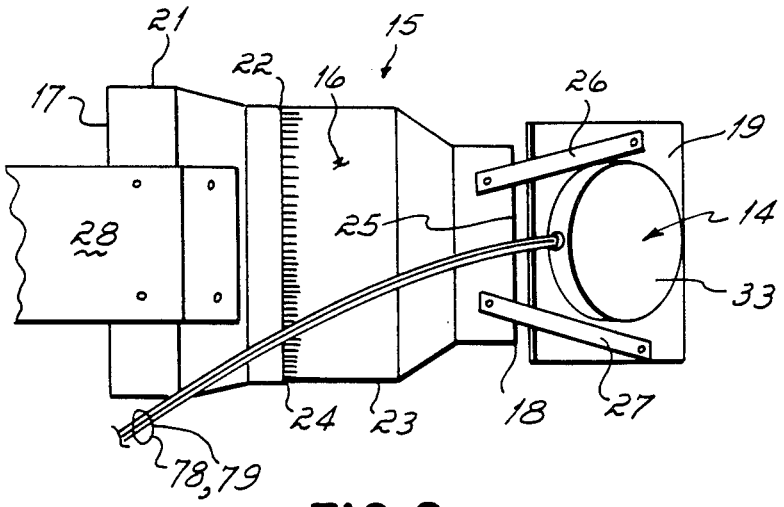
FIG. 2 is a overhead plan view of the present invention as seen on line 2—2 of FIG. 1.

As shown in FIG. 1 there is a ductless ceiling mounted furnace 10. Air is forced through a plurality of heat exchange tubes pass through the fire box (not shown). The air is heated in these tubes and forced back into the room at the front or exhaust side 12 of the heater 10 in the direction of arrows 13. A duty cycling control switch 14 is mounted in front of the exhaust side 12 of heater 10 by a bracket 15.

The bracket 15 includes a tapered conduit 16 having a large inlet opening 17 at one end and a smaller outlet opening 18 at the opposite end. An angled plate 19 is attached to the conduit 16 directly in front of small outlet opening 18 of the tapered conduit 16.

The tapered conduit 16 is preferably formed from two sections of galvanized heating duct. The first section 21 is preferably a circular reducing duct with a 7 inch inlet end which is the large opening 17 and a 6 inch outlet end 22. The second section 23 is also a circular reducing duct having a large six inch inlet end 24 and a smaller four inch outlet end which is the same as small opening 18. The tapered conduit is formed by force fitting the small outlet end 22 of the first section of duct 21 into the large inlet end 24 of the second duct section 23. Thus the tapered conduit has a 7 inch inlet opening 17 and a 4 inch outlet opening 18.

Mounted to the tapered conduit 16 forward of the outlet 18 is the angled plate 19. Angled plate 19 is fixed at approximately a 45° angle relative to the leading edge 25 of the tapered conduit 16. This plate is held in position by two metal straps 26 and 27 which are riveted to the second duct section 23 of the tapered conduit 16.

Upper and lower mounting bars 28 and 29 are riveted to the tapered conduit 16 above and below the large inlet opening 17 of the tapered conduit 16. The bars 28 and 29 extend directly away from the large inlet opening 17. The upper bar 28 extends approximately 16 inches and includes an inwardly bent flange 31 at the end opposite the end riveted to the tapered conduit 16. The lower or second bar 29 extends downwardly at about a 20° angle relative to the upper bar 28. The lower bar includes a flange 32 at the end of the bar opposite the end riveted to the tapered conduit 16.

The bracket 15 is mounted to the heater with the large inlet end directly in the path of the airflow from the heater. The bracket 15 is attached to the heater by bolting, screwing or riveting the flange 32 to the front of the heater. As shown in FIG. 1, the lower flange is connected to the front of the heater. Flange 31 is bent inwardly to permit it to hook onto a fin. Optionally it may be screwed or riveted to the fin.

The duty cycling switch 14 in turn is riveted to the angled plate 19.

The duty cycling control mechanism 14 can be any temperature sensitive switch which closes (breaks the circuit) on being heated. Preferably it is an adjustable temperature sensitive switch to permit adjustment of the switch to a particular unit. One preferred switch is that disclosed in the U.S. Pat. No. 4,470,267.

Figure 3:
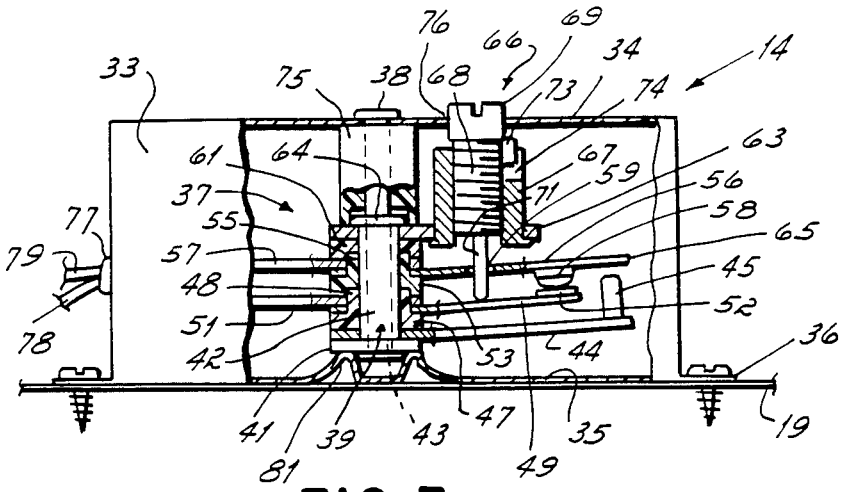
FIG. 3 is a cross sectional view of the duty cycling switch according for use in the present invention.

More particularly referring to FIG. 3 the duty cycling control switch 14 includes a metal casing 33 which has a cup shaped top cover 34 mounted on a base plate 35. Base plate 35 includes a mounting flange 36.

As shown in FIG. 3 the duty cycling control switch 14 includes a bi-metallic switch 37 mounted to the top cover 34 by a thermally conductive steel rivet 38. The switch 37 itself includes a brass holding rivet 39 which has a disc shaped head 41 and a hollow and brass stem 42. The internal diameter of the stem 42 is about equal to the external diameter of the stem 43 of brass rivet 38 permitting the passage of stem 43 of brass rivet 38 through the stem 42 of brass holding rivet 39 to hold the switch to the cover as described below.

The switch includes a bi-metal strip 44 mounted onto the stem 42 of brass holding rivet 39 resting against head 41. A non-conductive porcelain post 45 is fixed on the opposite end 46 of bi-metal strip 44.

Non-conductive annular spacer 47 is mounted on stem 42. The spacer 47 includes an upper annular boss 48. Mounted on this annular boss 48 and separated from the metal stem 42 is a first lower contact strip 49 and a lower terminal 51. The contact strip 49 includes a contact or point 52 directed away from the bi-metal strip 44. The terminal 51 and the contact strip 49 are both metallic, electrically conductive and in contact with each providing an electrical path from the terminal 51 to the contact 52. The annular boss 48 extends slightly above the first lower terminal 51.

A second annular non-conductive spacer 53 is mounted on stem 42 and nests on the annular boss 48. The annular boss 48 acts to maintain the terminal 51 and contact strip 49 insulated from the metal stem 42.

The second non-conductive spacer 53 also includes an annular boss 55. An upper contact strip 56 and a second upper terminal 57 are mounted on this annular boss 55.

The second contact strip 56 includes a second contact or point 58 directed towards the first point 52. Contact strip 56 further includes a centrally located aperture 59. Both the second contact strip 56 and the terminal 57 are metallic, electrically conductive and in physical contact with each other providing an electrical path from the terminal 57 to the second contact 58.

A third annular non-conductive spacer 61 is supported on the stem 42 in contact with terminal 57. Spacer 61 rests on annular boss 55. Thus, the annular boss 55 maintains the terminal 57 and the contact strip 56 insulated from the metallic stem 42.

A tab 63 is also supported on the stem 42. At the end of the stem 42 is an annular rivet head 64 which holds tab 63, spacer 61, terminal 57, contact strip 56, spacer 53, terminal 51, contact strip 49, spacer 47 and bi-metal strip 44 compressed together.

The two contact strips 49 and 56 are biased towards each other so that points 52 and 58 are normally in contact providing a complete electrical circuit between terminal 51 and terminal 57. Bi-metal strip 44 is positioned so that upon heating it bends moving post 45 towards an extended portion 65 of the contact strip 56.

Mounted on tab 63 is an adjusting means or control 66. The adjusting means 66 includes a hollow internally threaded metal sleeve 67 attached to tab 63 and an externally threaded set screw 68 within sleeve 67. The set screw 68 has a slotted head 69 adapted to receive the head of a screw driver. Mounted at the opposite end of the set screw 68 is a non-conductive post 71 which extends through centrally located aperture 59 in contact strip 56 to a point adjacent to the contact strip 49. Rotation of the set screw in one direction moves the post away from strip 49 allowing strip 49 to bend toward strip 56. When rotated in the opposite direction it pushes strip 49 away from strip 56 thus changing the distance from post 35 to the extended portion 65 of contact strip 56. This changes the distance that the bi-metal strip 44 must move to break the contact between two points 52 and 58 as well as the temperature at which the bi-metal switch is opened and closed. Set screw 68 further includes radially extended member 73 and internally threaded sleeve 67 includes a raised stop portion 74. Stop portion 74 lies in the path of the extended member 73, thereby limiting degree of rotation of set screw 68.

The switch 37 is mounted to the cover 34 by the steel rivet 38. The rivet passes through the switch 37, a spacer 75 and cover 34 and is swagged to hold the switch to the cover. The tubular spacer 75 holds the switch 37 the desired distance from the top of the cover 34 so that set screw 68 extends slightly above top cover 34 through aperture 76. This permits adjusting the switch 37 without removing the metal housing and while the housing and switch are mounted. Metal housing 33 further includes a rubber grommeted aperture 77 providing a passage for leads 78, 79 from terminals 51 and 57.

The lower metal plate 35 of the metal housing includes an annular inwardly raised portion 81 which in the assembled form contacts the head 41 of the mounting rivet 38 and provides an improved thermal conduction through the metal casing and to the brass rivet 39 and bi-metal strip 44.

Figure 4:
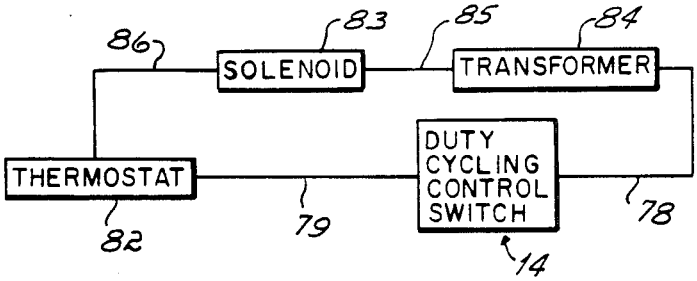
FIG. 4 is a circuit diagram showing the duty cycling switch and thermostat according to the present invention.

The furnace duty cycling control switch 14 is wired into the heater solenoid valve circuit (see FIG. 4) in series between the transformer 84 and the thermostat 82. Lead or wire 78 is attached to terminal 51. The solenoid is connected directly to a power supply which is a first pole (not shown) of transformer 84 by lead 85. A second lead from the solenoid also is connected to the second pole of transformer 84 but the connection is made through the duty cycling switch 14 and thermostat 82. Lead 78 from terminal 51 connects to the second pole of transformer 84 and lead 79 from terminal 57 connects to the thermostat 82. The thermostat in turn is connected to the solenoid 85 via lead 86. Thus the solenoid is activated only when the thermostat and the duty cycling switch are closed (i.e., circuit completed).

To adjust the mounted and wired duty cycling switch, the thermostat should be turned to a relatively high temperature, i.e., at least about 10–15° higher than the room temperature, normally causing the furnace to ignite and burn for an extended period of time in excess of five minutes. The duty cycling switch should be initially closed. As designed the burning in the heater heats up the fire box and heat exchangers which in turn heat up the air exiting from the heater. This air is blown through the heater and a portion of this enters the tapered duct 16 at inlet 17. This air in turn is concentrated as it passes through the duct 16 and is directed at plate 19 which in turn heats the mounting plate of the duty cycling switch 14 and finally the bi-metal strip which bends towards the contact strips. This in turn brings the porcelain knob or post 45 into contact with extended portion 65 of the contact strip 57 tending to separate the contact strips. The set screw 68 is then rotated to break contact between points 52 and 58 after a burn period of about 15 minutes. After 15 minutes the heat exchangers should be fully loaded. The adjustment caused by rotating set screw 68 alters the distance which extended portion 65 must be moved to separate the contacts so that at the five minute period, i.e., the time set screw 68 is adjusted, the contact is broken. This eliminates th electrical input into the solenoid 83 causing it to close the fuel valve cutting off fuel to the heater. While this is occurring the blower, which is independently activated, continues to blow cold air through the heater and drawing heat from the heater. As the temperature of the heater decreases so does the temperature of the air exiting from the heater. In turn, the temperature of the plate 19 also decreases and so does the bi-metal strip 44 which backs away from the contact strips and the points 52 and 58 will again contact each other completing the circuit and reinitiating the burn thus creating a cycle. When the temperature in the area being heated is hot enough to satisfy the thermostat, the thermostat will then break the circuit and discontinue the electrical input to solenoid 83 stopping the burn and stopping the cycle.

The bi-metal switch itself is basically an off-the-shelf item which can be purchased having a desired range of effectiveness preferably a slowly responding switch should be used. The temperature at which the duty cycling switch is reclosed is largely dependent on the bi-metal strip. A bi-metal switch which has an operating temperature of 250° F. adequately functions within range of a typical furnace plenum.

According to the present invention a temperature sensitive switch is mounted in a location relative to the heater so that it does not interfere with airflow but it is still contacted with a sufficient amount of heated air blown from the heater to effect the operation of the duty cycling switch thereby permitting use of an adjustable temperature sensitive switch with a ductless heater.

The duty cycling switch thereby acts to establish the maximum efficient temperature the heat exchangers should be permitted to reach. This will permit adaptation of this switch for a variety of different heating units. It takes into consideration the rapidity with which the heater cools down. Thus, if a heater cools down relatively quickly the temperature sensitive switch will close quickly causing the solenoid valve to open providing fuel and thereby additional burning to supply heat to the heater.

Thus having described my invention, I claim:

1. A ceiling mounted heat exchanger having a blower means to blow air through said heat exchanger and through an outlet;

a bracket mounted forwardly of said outlet, said bracket including a tapered conduit, said conduit having an inlet end and an outlet end and mounted to said heater with said inlet end positioned with respect to said outlet from said heat exchange to receive air blown by said blower through said outlet;

means to mount a temperature sensitive switch forwardly of said tapered conduit whereby air passing through said tapered conduit and through the outlet of said conduit contacts said temperature sensitive switch.

* * * * *